US006382871B1

(12) United States Patent
Ross

(10) Patent No.: US 6,382,871 B1
(45) **Date of Patent: *May 7, 2002**

(54) ASPHALT MOLDING SYSTEM

(76) Inventor: Guy Ross, 2446 Bank St. #304, Ottawa, Ontario (CA), K1V 1A8

( * ) Notice: Subject to any disclaimer, the term of this patent is extended or adjusted under 35 U.S.C. 154(b) by 0 days.

This patent is subject to a terminal disclaimer.

(21) Appl. No.: 09/619,443

(22) Filed: Jul. 19, 2000

(51) Int. Cl.[7] ..... E01C 7/06; E01C 23/16; B05D 3/00; B05D 5/00

(52) U.S. Cl. ..... 404/75; 404/89; 404/93; 427/272; 427/278

(58) Field of Search ..... 404/17, 19, 32, 404/39, 42, 72, 74, 75, 77, 89, 93; 249/2, 52, 60, 188, 203, 207; 52/311.1, 316, 741.1; 427/270, 271, 272, 273, 274, 278, 282

(56) References Cited

U.S. PATENT DOCUMENTS

| | | | | | |
|---|---|---|---|---|---|
| 451,799 | A | * | 5/1891 | Bleiss | 52/311.1 |
| 967,714 | A | * | 8/1910 | Blome et al. | 404/93 |
| 2,595,142 | A | * | 4/1952 | Herck | 264/31 |
| 3,516,339 | A | * | 6/1970 | Perkins | 404/75 |
| 3,664,242 | A | * | 5/1972 | Harrington et al. | 404/77 |
| 3,822,556 | A | * | 7/1974 | Cramwinckel et al. | 405/270 |
| 3,832,079 | A | * | 8/1974 | Moorhead | 404/72 |
| 3,910,711 | A | * | 10/1975 | Moorhead | 404/89 |
| 4,135,840 | A | * | 1/1979 | Puccini et al. | 404/93 |
| 4,574,100 | A | * | 3/1986 | Mercer | 428/134 |
| 4,776,723 | A | * | 10/1988 | Brimo | 404/89 |
| 5,215,402 | A | | 6/1993 | Stowell et al. | |
| 5,447,752 | A | * | 9/1995 | Cobb | 264/31 |
| 5,494,372 | A | * | 2/1996 | Oliver et al. | 404/72 |
| 5,502,941 | A | * | 4/1996 | Zember et al. | 42/314 |
| 6,024,511 | A | | 2/2000 | Ross | |

FOREIGN PATENT DOCUMENTS

| | | | |
|---|---|---|---|
| JP | 11-29905 | * | 2/1999 |

* cited by examiner

*Primary Examiner*—Gary S. Hartmann
(74) *Attorney, Agent, or Firm*—Ronald G. Bitner

(57) ABSTRACT

A method for molding a pattern on the surface of heated asphalt. The method includes: providing an asphalt molding mesh comprising pattern molding elements formed of an elastic material having a V-shaped cross-section in a configuration corresponding to a pattern to be molded in the asphalt. The mesh is then heated to substantially equalize with that of the surface of the asphalt. The mesh is positioned and inserted at least partially into the asphalt. The mesh and asphalt are rolled over to mold the asphalt and compact the asphalt about the mesh. Water is applied to the surface of the asphalt while rolling to limit the heating and expansion and buckling of the mesh. Finally, molding mesh is removed from the asphalt.

3 Claims, 2 Drawing Sheets

ASPHALT MOLDING SYSTEM

FIELD OF THE INVENTION

This invention relates to a system for molding a pattern onto the surface of asphalt.

BACKGROUND OF THE INVENTION

The aesthetic appearance of roads, parking lots and driveways, particularly those made of asphalt, can be improved by molding a pattern onto the surface, which for example, can be made to resemble brick, cobblestone, stone, or the like.

Various methods for imprinting asphalt or concrete have been attempted, or proposed. For example, U.S. Pat. Nos. 3,832,079 and 3,910,711 to Moorhead describe a concrete or paving forming apparatus and process whereby a roller forms a pattern in the pavement and an intervening sheet of plastic film is said to prevent binding and gouging of the pavement surface. U.S. Pat. No. 4,105,354 to Bowman shows a wheel-like imprinting device having blades on a circular frame, and is propelled and ballasted by a person. U.S. Pat. No. 5,215,402 to Stowell & Zaseybida describes a grid-like "template", comprising cables, that is progressively compressed into, and lifted from, the previously rolled asphalt surface. This method is labor intensive and leaves many defects caused by the multiple seams and also by compressing with rollers or plates, the cables move and tends to make non-uniform patterns. The slower process also causes problems with maintaining proper temperature of the asphalt. With this proposal if the temperature of the asphalt is too hot, it is difficult to prevent the template from sinking and getting buried in the asphalt resulting in damage to the surface when removed, and if the asphalt is too cold, it is difficult to imprint the asphalt. Also, the cable is difficult to remove from the asphalt due to the cross-sectional shape of the cable and the shape of the impression that it produces.

U.S. Pat. No. 6,024,511, to Ross, discloses an apparatus for imprinting a pattern on the surface of asphalt comprising an endless belt having pattern forming elements mounted on a pair of rollers, and a weighted roller for pressing the belt into the asphalt. This apparatus is suitable for imprinting regularly repeating patterns over a considerable length, but is not well suited for imprinting smaller or non-repeating patterns, such as circular or other non-linear patterns.

SUMMARY OF THE INVENTION

An object of the present invention to provide a relatively simple system for molding a pattern on the surface of asphalt without damage to the surface.

A specific object of the present invention is to provide a system for molding a pattern onto the surface of asphalt that allows rolling the surface for compaction without damaging the molded surface.

It has been found that improved molding of asphalt can be achieved by a system utilizing a molding mesh made of elastic material that is inserted into the surface of heated asphalt and allows rolling with the mesh in place. The success of the system is made possible by following a certain procedure that involves the utilization of water to limit the expansion, and resulting buckling, of the elastic molding mesh when inserted into the hot asphalt.

The present invention provides a system for molding a pattern on the surface of asphalt comprising: providing an asphalt molding mesh comprising pattern molding elements formed of an elastic material and having a V-shaped cross-section in a configuration corresponding to a pattern to be molded in the asphalt; heating the mesh to substantially equalize with that of the surface of the asphalt; positioning and inserting the mesh at least partially into the asphalt; rolling over the mesh and asphalt to mold and compact the asphalt about the mesh; applying water to the surface of the asphalt while rolling to limit the heating and expansion and buckling of the mesh; and after rolling removing the molding mesh from the asphalt.

DESCRIPTION OF THE PREFERRED EMBODIMENTS

Figure 1:
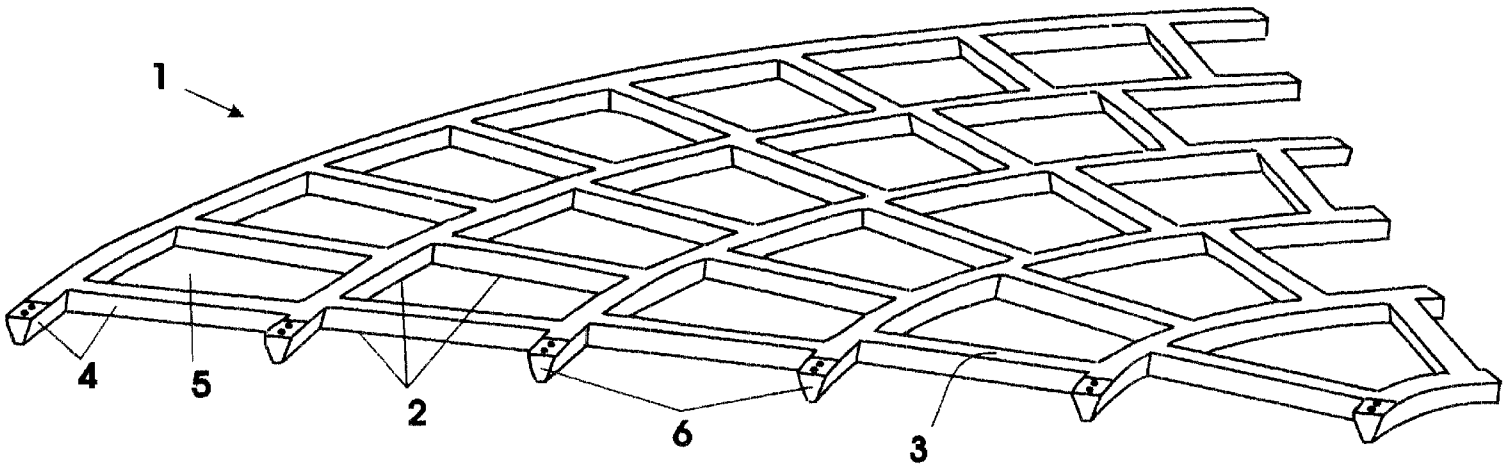
FIG. 1 is a perspective view of one embodiment of an asphalt molding mesh for the present invention.
Figure 2:
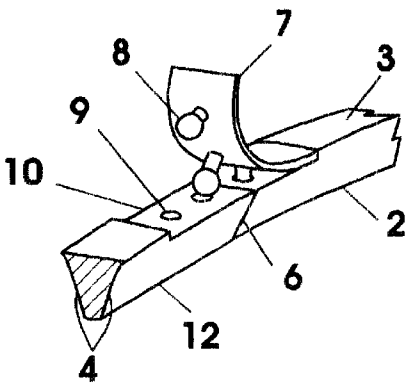
FIG. 2 is an enlarged view of a connector for connecting a plurality of mesh units.
Figure 3A:
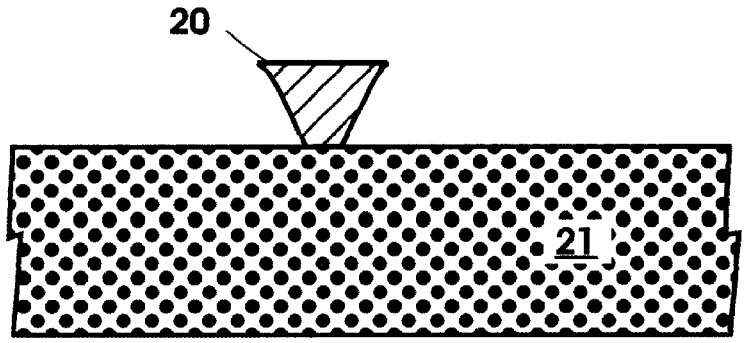
FIG. 3*a*–3*d* are a schematic representation of the operation of the system, illustrating various steps 3(*a*), 3(*b*), 3(*c*) and 3(*d*) of the operation.
Figure 3B:
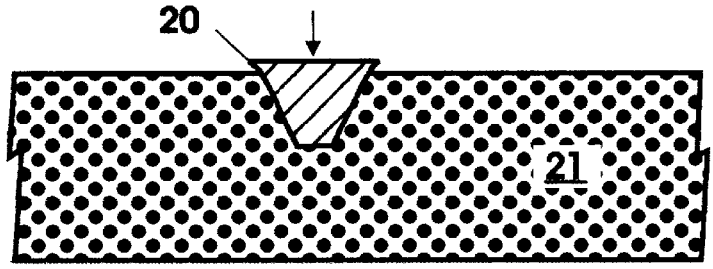
Figure 3C:
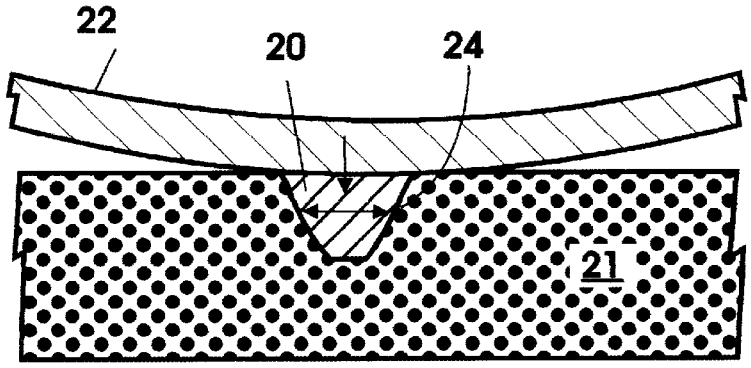
Figure 3D:
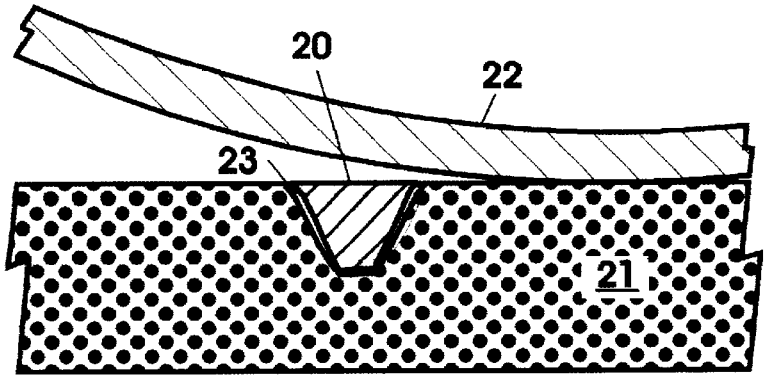

With reference to FIGS. 1 and 2, the present invention utilities an asphalt molding mesh 1 formed of an elastic material having pattern molding elements 2 in a configuration corresponding to a pattern to be molded into the asphalt. The mesh has a V-shaped cross-section to facilitate insertion and removal from the asphalt. The mesh is provided with a flat upper surface 3 for contact by the roller and converging V-shaped side walls 4. The mesh defines open spaces 5 between the pattern molding elements 2.

The molding mesh 1 may be made up of a plurality of mesh units interconnected at one or more end portions 6 by suitable interconnecting elements 7, such as illustrated in FIG. 2.

The abutting end portions 6 of adjacent units 1 are shown connected by means of a flexible bridging connecting element 7 having protrusions 8 that mate with receiving apertures 9 near the ends 6 of the adjacent unit As shown, the abutting end portions 6 have a reduced height or recesses 10 to accommodate the thickness of the bridging element 7, such that the upper surface of the joined units remain substantially flush throughout.

In operation, with reference to FIG. 3, the mesh 20, is applied onto the surface of the heated asphalt 21, as shown in FIG. 3(*a*), which typically will be freshly laid asphalt applied by conventional machines. Placing the mesh on the surface on the heated asphalt heats the mesh allowing the temperature of the mesh to substantially equalize with that of the surface of the asphalt before being inserted into the asphalt. This equalizing of the temperature avoids subsequent differential expansion and buckling of the mesh.

With reference to FIG. 3(*b*), when the mesh temperature substantially equalized with that of the asphalt surface, the mesh is positioned and inserted into the freshly laid asphalt by suitable means, such as by manually stepping onto it. Inserting the mesh at least partially into the asphalt prevents shifting during the subsequent rolling operation. Water is applied to facilitate temperature control and reduce sticking, as will be described.

With reference to FIG. 3(*c*), with the mesh in place, the asphalt is rolled with a suitable roller 22 to uniformly position the mesh 20 into the asphalt 21, molding asphalt with the desired pattern and compacting the asphalt about the mesh. The flat upper surface of the mesh allows repeated rolling over the mesh without dislodging. Repeated rolling also serves to complete and enhance the molding of the pattern as the mesh is repeatedly pushed down by the roller. The open spaces between the pattern molding elements allow compaction and finishing of these regions in a conventional manner. Furthermore, the use of an open mesh facilitates insertion, and reduces the tendency of buckling.

Water is supplied to the surface of the asphalt while rolling. The use of water prevents sticking and facilitates limiting temperature rise of the mesh and maintaining it equalized to that of the surface of the asphalt. Otherwise, problems can arise due to the higher temperature of the asphalt below the surface. This presents a problem, in that when the mesh is inserted into the hotter asphalt below the surface, the temperature of the mesh would tend to rise and expand and buckle or distort as a result A buckled mesh presents difficulties for a subsequent pass with the roller 22. The application of water limits the temperature rise and the resulting expansion and buckling of the mesh from the heat of lower regions of the asphalt. It should be noted that water is conventionally used while rolling to prevent sticking of the roller to the asphalt. Therefore, conventional equipment can be conveniently used to apply the proper amounts of water, typically greater amounts, for the purpose of the present invention, as described above.

The operation of the present invention will preferably be preformed on freshly laid hot asphalt prior to rolling and compaction. The temperature of the asphalt will typically be from about 225 to 300° F. As indicated above, placing the mesh on the hot asphalt will raise its temperature. With the application of water on the surface, the mesh and upper surface of asphalt will be at approximately equal temperature of about 160 to 200° F. for rolling.

The V-shaped cross-section of the pattern molding elements of the mesh facilitates removal of the mesh after the rolling operation. With the present shape, the widest part of the mesh is at the surface of the asphalt and the narrower side wall portions 24 prevents it from being buried during rolling and facilitates release from the asphalt, after the asphalt has cooled and hardened. The flat upper surface of the mesh allows unhindered rolling of the asphalt for compaction of the surface in a conventional manner.

After the rolling operation is completed, cooling causes the molding mesh to contract. The contraction is usually sufficient to cause large portions of the mesh to lift and separate from the asphalt surface, due to the V-shaped cross-section. This lifting and separation provides a convenient indication that the mesh is ready to be removed, and removed easily.

The use of a V-shaped mesh cross-section molds a pattern having downwardly sloping sides that is less susceptible to crumbling and damage from freezing of accumulated water. Preferably, as shown in FIGS. 2 and 3, the top portion will be flared to produce rounded edges along the top of the molded pattern, since a sharp edge would be susceptible to crumbling.

The use of an elastic material for the molding mesh facilitates the reduction of the temperature rise and expansion and resulting distortion of the mesh and also facilitates the subsequent removal from the asphalt, as follows. With reference to FIGS. 3(*c*) and 3(*d*), when pushed down by the roller, the elastic mesh elements 20 will expand horizontally against the asphalt to produce a cavity larger than the size of the mesh when the pressure is subsequently released. This larger cavity leaves spaces 23 into which water can penetrate in order to cool the lower submerged region of the mesh, as shown in FIG. 3(*d*). The resulting spaces 23 also facilitates separation and removal of the mesh from the asphalt as described further below.

It should be noted that two separate steps are taken to limit the expansion of the mesh after being inserting into the hot asphalt. Firstly, the mesh is initially heated by placement on the surface of the asphalt. Secondly, the temperature rise while being inserted into the hot asphalt is limited by the use of water, as described above.

When the molding and rolling is complete, the molding mesh is removed from the asphalt for subsequent use in another location, as desired It should be noted, that when the mesh is reused at a new location, and is still hot, the heating step, or the time needed for temperature equalization, can be eliminated or reduced.

The mesh is formed of a deformable material, such as rubber, with a certain degree of elasticity, but little compressibility, so that when pushed down by the roller, it spreads laterally outward whereby the pattern molding elements will be wider than when roller pressure is subsequently released. The use of such an elastic material allows the mesh pattern molding elements to contract slightly when roller pressure is released to provide a clean separation from the asphalt for removal.

A material found to be suitable for the mesh was Buna-N polymer rubber having an ASTM Durometer, type "A", Hardness of 80. It appears that suitable hardness values are in the range of from 50 to 100. The material should be capable of withstanding the elevated temperature of the asphalt surface and the oil and chemicals in the asphalt. It appears that molding mesh dimensions of from ¼ to ¾ inches in depth are suitable.

The molding mesh can be initially inserted into the asphalt manually by stepping onto it, or by other means. For example, by using a large roller for the rolling/compacting step, the roller itself can be used to preform the insertion as it initially passes over the mesh the first time. This is made possible, since a large roller will contact and push downward on the higher mesh before it contacts and compacts the asphalt immediately around the mesh. It is important to note that whatever method of mesh insertion is used, it must be done before the asphalt is compacted, since the elastic mesh cannot be inserted into compacted asphalt. The advantages of using an elastic material are discussed above.

It will be understood that various types of patterns may be molded, with corresponding changes in the mesh pattern. The pattern may simulate brick, cobblestone, stone, or provide a unique artistic pattern, or provide text information, such as for displaying parking restrictions. Also, various combinations of mesh units of similar or differing patterns may be interconnected by various means.

It will also be appreciated that the patterned surface produced by the present invention may be treated with a colored sealer, stain, pigment, or other suitable colorant to provide a more realistic simulating effect.

What is claimed is:

1. A method for molding a pattern on the surface of hot moldable asphalt comprising:

providing a hot moldable asphalt surface;

providing an asphalt molding mesh comprising pattern molding elements formed of an elastic material having a V-shaped cross-section in a configuration corresponding to a pattern to be molded in the asphalt;

said elastic material forming the mesh having sufficient elasticity to provide some laterally widening of the pattern molding elements on the mesh surface when subjected to downward pressure against the asphalt surface, such that upon release of pressure the pattern molding elements of the mesh narrow to facilitate separation from the asphalt;

heating the mesh to substantially equalize with that of the surface of the asphalt;

positioning and inserting the mesh at least partially into the asphalt;

rolling over the mesh and asphalt to mold and compact the asphalt about the mesh;

applying water to the surface of the asphalt while rolling to limit the heating and expansion and buckling of the mesh; and after rolling removing the molding mesh from the asphalt.

2. The method of claim 1, wherein the pattern molding elements are formed of rubber.

3. The method of claim 1, wherein the mesh is heated by applying the mesh onto the surface of the asphalt and allowing the temperature to substantially equalize with that of the surface of the hot asphalt.

* * * * *